US010900481B2

(12) United States Patent
Singal et al.

(10) Patent No.: US 10,900,481 B2
(45) Date of Patent: Jan. 26, 2021

(54) ROD PUMPING UNIT AND METHOD OF OPERATION

(71) Applicant: General Electric Company, Schenectady, NY (US)

(72) Inventors: Kalpesh Singal, Glenville, NY (US); Shyam Sivaramakrishnan, Edmond, OK (US); Justin Edwin Barton, Glenville, NY (US)

(73) Assignee: Ravdos Holdings Inc., New York, NY (US)

( * ) Notice: Subject to any disclaimer, the term of this patent is extended or adjusted under 35 U.S.C. 154(b) by 555 days.

(21) Appl. No.: 15/099,342

(22) Filed: Apr. 14, 2016

(65) Prior Publication Data

US 2017/0298925 A1 Oct. 19, 2017

(51) Int. Cl.
*F04B 49/06* (2006.01)
*E21B 43/12* (2006.01)
(Continued)

(52) U.S. Cl.
CPC ..... *F04B 49/065* (2013.01); *E21B 43/126* (2013.01); *E21B 47/008* (2020.05); *F04B 23/02* (2013.01); *F04B 23/106* (2013.01); *F04B 35/00* (2013.01); *F04B 47/02* (2013.01); *F04B 47/022* (2013.01); *F04B 49/06* (2013.01); *F04B 49/20* (2013.01); *F04B 53/10* (2013.01);
(Continued)

(58) Field of Classification Search
CPC ..... F04B 49/065; F04B 49/06; F04B 49/20; F04B 23/02; F04B 23/106; F04B 47/022; F04B 47/02; F04B 53/10; F04B 35/00; F04B 2201/121; F04B 2201/1202; F04B 2203/0207; E21B 47/0007; E21B 43/126; E21B 43/12; E21B 37/06
See application file for complete search history.

(56) References Cited

U.S. PATENT DOCUMENTS 2,808,735 A 10/1957 Becker
2,995,048 A 8/1961 Mitchell et al.
(Continued)

FOREIGN PATENT DOCUMENTS

WO 2009/052175 A1 4/2009

OTHER PUBLICATIONS

International Search Report and Written Opinion issued in connection with corresponding PCT Application No. PCT/US2017/027365 dated Sep. 28, 2017.
(Continued)

*Primary Examiner* — Essama Omgba
*Assistant Examiner* — Christopher J Brunjes
(74) *Attorney, Agent, or Firm* — Dentons Cohen & Grigsby P.C.

(57) ABSTRACT

A controller for operating a prime mover of a rod pumping unit includes a processor configured to operate the prime mover over a first stroke and a second stroke. The controller is further configured to compute a first motor torque imbalance value for the first stroke and engage adjustment of a counter-balance. The controller is further configured to estimate a second motor torque imbalance value for the second stroke. The controller is further configured to disengage adjustment of the counter-balance during the second stroke upon the second motor torque imbalance value reaching a first imbalance range.

12 Claims, 5 Drawing Sheets

(51) Int. Cl.

| | |
|---|---|
| ***E21B 47/008*** | (2012.01) |
| ***F04B 35/00*** | (2006.01) |
| ***F04B 49/20*** | (2006.01) |
| ***F04B 47/02*** | (2006.01) |
| ***F04B 23/02*** | (2006.01) |
| ***F04B 23/10*** | (2006.01) |
| ***F04B 53/10*** | (2006.01) |

(52) U.S. Cl.
CPC . *F04B 2201/121* (2013.01); *F04B 2201/1202* (2013.01); *F04B 2203/0207* (2013.01)

(56) References Cited

U.S. PATENT DOCUMENTS 4,490,094 A 12/1984 Gibbs
4,715,240 A 12/1987 Erich
5,180,289 A * 1/1993 Wenholz ..... F04B 47/028 417/53
7,219,036 B2 5/2007 Abbotoy et al.
8,272,845 B1 9/2012 Watson
8,851,860 B1 * 10/2014 Mail ..... F04B 47/02 166/105
9,115,574 B2 * 8/2015 Doyle ..... E21B 43/127
2013/0306326 A1 * 11/2013 Doyle ..... E21B 43/127 166/369
2013/0336721 A1 * 12/2013 McBride ..... E21D 11/00 405/55
2016/0003234 A1 * 1/2016 Mills ..... F04B 49/065 417/18
2016/0222957 A1 * 8/2016 Robison ..... E21B 43/121

OTHER PUBLICATIONS

Xinufu Liu et al., "An approach to the computation of motor loading for a pumping unit", Industrial Mechatronics and Automation (ICIMA), 2010 2nd International Conference on, vol. 1, pp. 118-121, May 30-31, 2010, Wuhan, China.
Xinufu Liu et al., "A Modern Approach to the Design Calculation of Torque Loadings on a Pumping Unit Gearbox", Information Engineering (ICIE), 2010 WASE International Conference on, vol. 3, pp. 132-135, Aug. 14-15, 2010, Beidaihe, Hebei.

* cited by examiner

ROD PUMPING UNIT AND METHOD OF OPERATION

BACKGROUND

The field of the disclosure relates generally to rod pumping units and, more particularly, to a rod pumping unit controller and method of operation for controlling a counter-balance during operation of the rod pumping unit.

Most known rod pumping units (also known as surface pumping units) are used in wells to induce fluid flow, for example oil and water. Examples of rod pumping units include, for example, and without limitation, linear pumping units and beam pumping units. Rod pumping units convert rotating motion from a prime mover, e.g., an engine or an electric motor, into reciprocating motion above the well head. This motion is in turn used to drive a reciprocating downhole pump via connection through a sucker rod string. The sucker rod string, which can extend miles in length, transmits the reciprocating motion from the well head at the surface to a subterranean piston, or plunger, and valves in a fluid bearing zone of the well. The reciprocating motion of the piston valves induces the fluid to flow up the length of the sucker rod string to the well head.

Typically, known rod pumping units impart continually varying motion on the sucker rod string. The sucker rod string responds to the varying load conditions from the surface unit, down-hole pump, and surrounding environment by altering its own motion statically and dynamically. The sucker rod string stretches and retracts as it builds the force necessary to move the down-hole pump and fluid. The rod pumping unit, breaking away from the effects of friction and overcoming fluidic resistance and inertia, tends to generate counter-reactive interaction force to the sucker rod string exciting the dynamic modes of the sucker rod string, which causes an oscillatory response. Traveling stress waves from multiple sources interfere with each other along the sucker rod string (some constructively, others destructively) as they traverse its length and reflect load variations back to the rod pumping unit. The resulting variable load on the rod pumping unit introduces inefficiencies in operating the rod pumping unit. For example, and without limitation, a variable load may introduce a torque imbalance on the prime mover, where a difference in peak torque values during an upstroke and a downstroke is non-zero. Such a torque imbalance, also referred to as a motor torque imbalance, is conventionally mitigated by a counter-balance.

BRIEF DESCRIPTION

In one aspect, a controller for operating a prime mover of a rod pumping unit is provided. The controller includes a processor configured to operate the prime mover over a first stroke and a second stroke. The controller is further configured to compute a first motor torque imbalance value for the first stroke and engage adjustment of a counter-balance. The controller is further configured to estimate a second motor torque imbalance value for the second stroke. The controller is further configured to disengage adjustment of the counter-balance during the second stroke upon the second motor torque imbalance value reaching a first imbalance range.

In another aspect, a method of operating a rod pumping unit is provided. The method includes operating a prime mover of the rod pumping unit over a first stroke and a second stroke. The method further includes computing a first motor torque imbalance value for the first stroke and engaging adjustment of a counter-balance. The method further includes estimating a second motor torque imbalance value for the second stroke. The method further includes disengaging adjustment of the counter-balance during the second stroke upon the second motor torque imbalance value reaching a first imbalance range.

In yet another aspect, a rod pumping unit is provided. The rod pumping unit includes a prime mover coupled to a ram within a pressure vessel. The rod pumping unit further includes a compressor, a bleed valve, and a rod pumping unit controller. The compressor and bleed valve are coupled to the pressure vessel. The compressor is configured to increase a pressure in the pressure vessel when the compressor is engaged. The bleed valve is configured to decrease the pressure in the pressure vessel when the bleed valve is engaged. The rod pumping unit controller is coupled to the compressor and the bleed valve, and is configured to operate the prime mover over a first stroke and a second stroke. The rod pumping unit controller is further configured to compute a first motor torque imbalance value for the first stroke and engage one of the compressor and the bleed valve to adjust a counter-balance. The rod pumping unit controller is further configured to estimate a second motor torque imbalance value for the second stroke. The rod pumping unit controller is further configured to disengage the compressor and the bleed valve during the second stroke upon the second motor torque imbalance value reaching a first imbalance range.

DRAWINGS

These and other features, aspects, and advantages of the present disclosure will become better understood when the following detailed description is read with reference to the accompanying drawings in which like characters represent like parts throughout the drawings, wherein.

Figure 1:
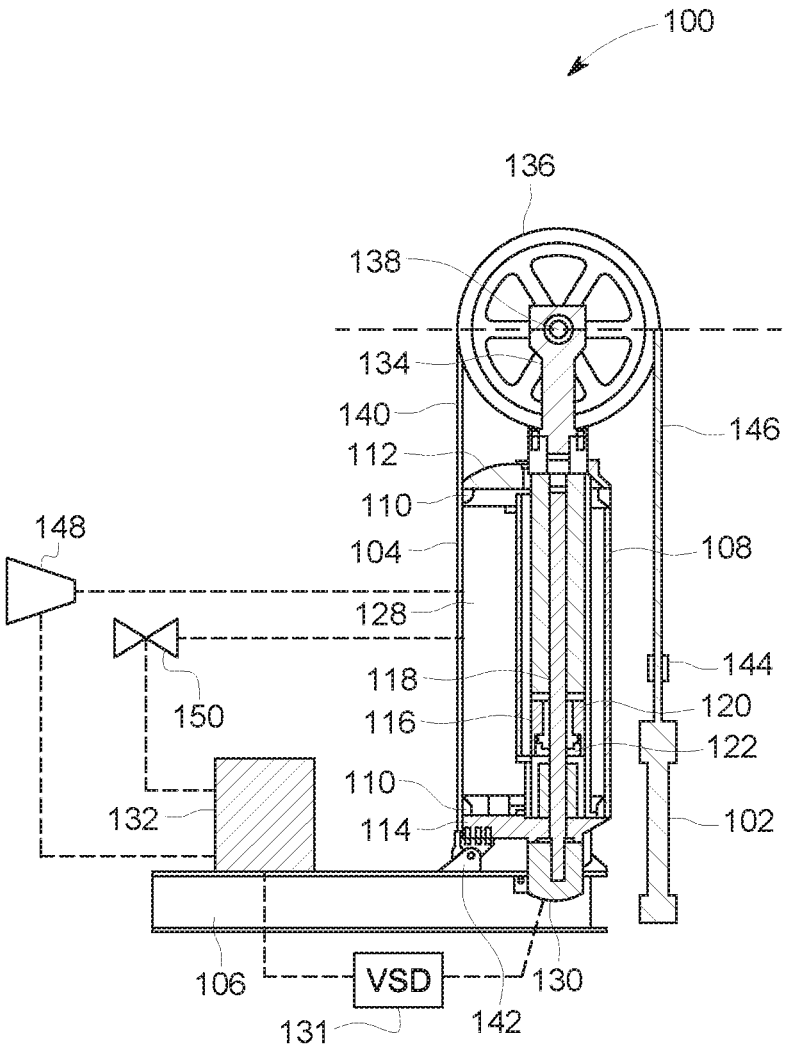
FIG. 1 is a cross-sectional view of an exemplary rod pumping unit in a fully retracted position.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

Embodiments of the present disclosure relate to a controller for a rod pumping unit. The controllers described herein, within a rod pumping unit stroke, estimate torque imbalance on the prime mover for that stroke based on measured torque imbalance for a previous stroke. The controllers use the estimated torque imbalance to engage or disengage an adjustment to a counter-balance in real-time within the stroke. Real-time engagement and disengagement of adjustments to the counter-balance facilitate the controllers operating the rod pumping unit such that torque imbalance on the prime mover efficiently converges to a desired range.

Figure 2:
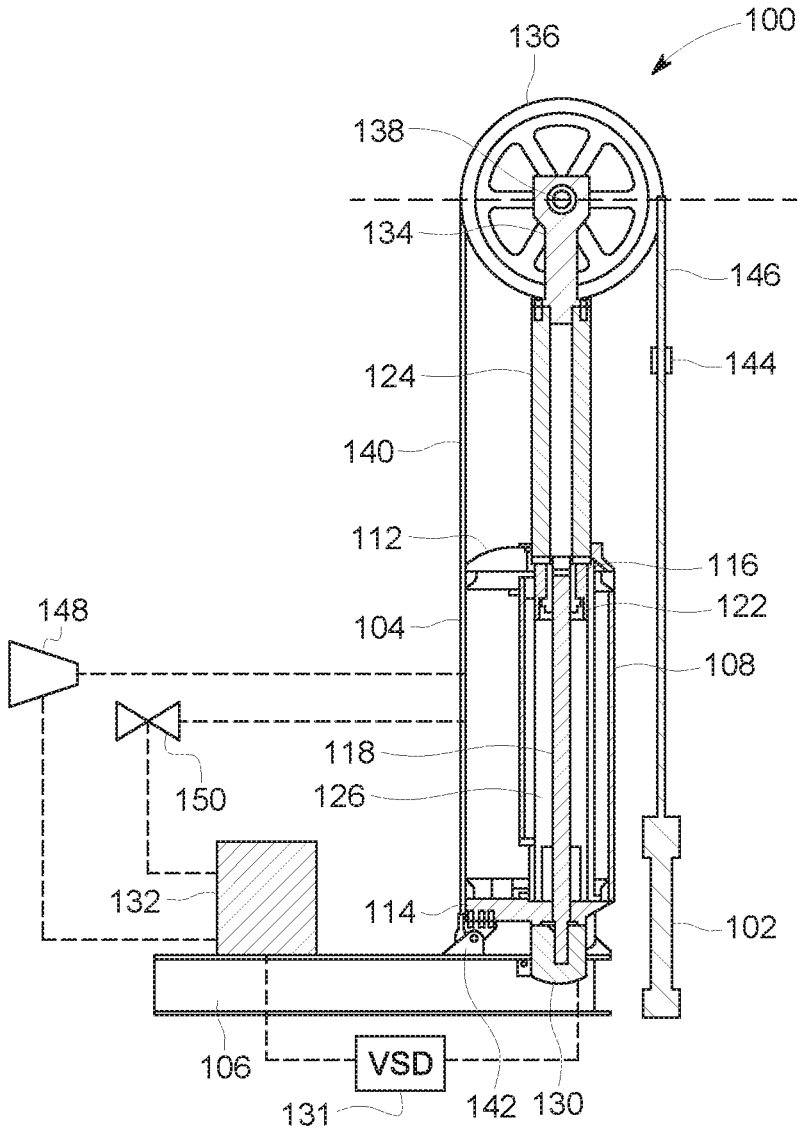
FIG. 2 is a cross-sectional view of the rod pumping unit shown in FIG. 1 in a fully extended position.

FIGS. 1 and 2 are cross-sectional views of an exemplary rod pumping unit 100 in fully retracted (1) and fully extended (2) positions, respectively. In the exemplary embodiment, rod pumping unit 100 (also known as a linear pumping unit) is a vertically oriented rod pumping unit having a linear motion vertical vector situated adjacent to a well head 102. Rod pumping unit 100 is configured to transfer vertical linear motion into a subterranean well (not shown) through a sucker rod string (not shown) for inducing the flow of a fluid. Rod pumping unit 100 includes a pressure vessel 104 coupled to a mounting base structure 106. In some embodiments, mounting base structure 106 is anchored to a stable foundation situated adjacent to the fluid-producing subterranean well. Pressure vessel 104 includes a cylindrical or other appropriately shaped shell body 108 constructed of, for example, and without limitation, rolled steel plate, and further includes cast or machined end flanges 110. Attached to the end flanges 110 are upper and lower pressure heads 112 and 114, respectively.

Penetrating upper and lower pressure vessel heads 112 and 114, respectively, is a linear actuator assembly 116 that includes a vertically oriented threaded screw 118 (also known as a roller screw), a planetary roller nut 120 (also known as a roller screw nut assembly), a forcer ram 122 in a forcer ram tube 124, and a guide tube 126. Pressure vessel 104 is coupled to a compressor 148 that compresses a fluid within pressure vessel 104 to build or increase a pressure that acts on forcer ram 122 as a counter-balance force. Pressure vessel 104 is further coupled to a bleed valve 150 that releases the fluid from pressure vessel 104 to relieve or decrease the pressure acting on forcer ram 122, thereby reducing the counter-balance force. The fluid in pressure vessel 104 may include, for example, and without limitation, air.

Roller screw 118 is mounted to an interior surface 128 of lower pressure vessel head 114 and extends up to upper pressure vessel head 112. The shaft extension of roller screw 118 continues below lower pressure vessel head 114 to connect with a compression coupling (not shown) of a motor 130, i.e., the prime mover. Motor 130 is coupled to a variable speed drive (VSD) 131 configured such that the motor's 130 rotating speed may be adjusted continuously. VSD 131 also reverses the motor's 130 direction of rotation so that its range of torque and speed may be effectively doubled. Roller screw 118 is operated in the clockwise direction for the upstroke and the counterclockwise direction for the downstroke. Motor 130 is in communication with a rod pumping unit controller 132. In the exemplary embodiment, pumping unit controller 132 transmits commands to motor 130 and VSD 131 to control the speed, direction, and torque of roller screw 118.

Within pressure vessel 104, the threaded portion of roller screw 118 is interfaced with planetary roller screw nut assembly 120. Nut assembly 120 is fixedly attached to the lower segment of forcer ram 122 such that as roller screw 118 rotates in the clockwise direction, forcer ram 122 moves upward. Upon counterclockwise rotation of roller screw 118, forcer ram 122 moves downward. This is shown generally in FIGS. 1 and 2. Guide tube 126 is situated coaxially surrounding forcer tube 124 and statically mounted to lower pressure head 114. Guide tube 126 extends upward through shell body 108 to slide into upper pressure vessel head 112.

An upper ram 134 and a wireline drum assembly 136 and fixedly coupled and sealed to the upper end of forcer ram 122. Wireline drum assembly 136 includes an axle 138 that passes laterally through the top section of the upper ram 134. A wireline 140 passes over wireline drum assembly 136 resting in grooves machined into the outside diameter of wireline drum assembly 136. Wireline 140 is coupled to anchors 142 on the mounting base structure 106 at the side of pressure vessel 104 opposite of well head 102. At the well head side of pressure vessel 104, wireline 140 is coupled to a carrier bar 144 which is in turn coupled to a polished rod 146 extending from well head 102.

Rod pumping unit 100 transmits linear force and motion through planetary roller screw nut assembly 120. Motor 130 is coupled to the rotating element of planetary roller screw nut assembly 120. By rotation in either the clockwise or counterclockwise direction, motor 130 may affect translatory movement of planetary roller nut 120 (and by connection, of forcer ram 122) along the length of roller screw 118.

Figure 3:
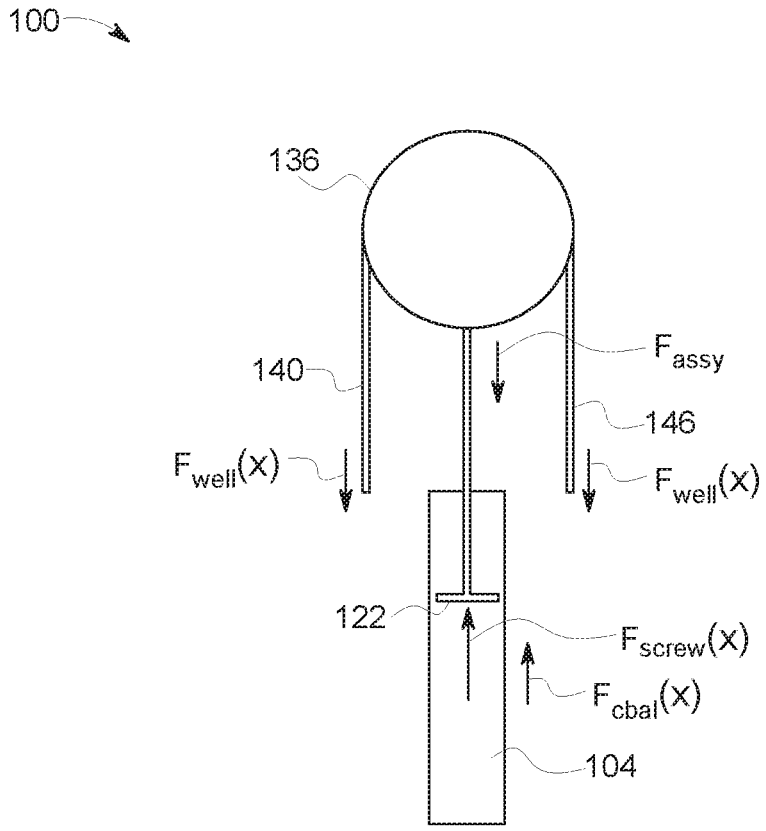
FIG. 3 is a force diagram for the rod pumping unit shown in FIGS. 1 and 2.

FIG. 3 is a force diagram for rod pumping unit 100 (shown in FIGS. 1 and 2). For clarity, FIG. 3 depicts wireline drum assembly 136, wireline 140, polished rod 146, pressure vessel 104, and forcer ram 122. When motor 130 drives forcer ram 122 upward, the load, $F_{screw}$, on roller screw 118 includes the weight of wireline drum assembly 136, $F_{assy}$, as well as the weight of the sucker rod string (not shown) suspended from polished rod 146. The weight of the sucker rod string and the fluid is also referred to as the well load, $F_{well}$, and acts doubly on roller screw 118, because wireline 140 is attached at anchors 142, providing a tension in wireline 140 equal and opposite the well load, $F_{well}$. The load, $F_{screw}$, on roller screw 118 also includes an inertial component for wireline drum assembly 136. The load, $F_{screw}$, on roller screw 118 is reduced by a counter-balance force, $F_{cbal}$. Counter-balance force, $F_{cbal}$, is a function of a surface area, A, of forcer ram 122 and the pressure in pressure vessel 104. Counter-balance force, $F_{cbal}$, produces a counter-balance, or a counter-balance effect, for rod pumping unit 100. For a downstroke, roller screw 118 acts against the counter-balance force, $F_{cbal}$. The load, $F_{screw}$, on roller screw 118 is the sum of these forces and is represented by the following equation:

$$F_{screw}(x)=2\cdot F_{well}(x)+m_{assy}\cdot g+m_{assy}\cdot\ddot{x}-F_{cbal}(x), \quad \text{Eq. (1)}$$

where, $m_{assy}$ is the mass of wireline drum assembly 136, g is the acceleration of gravity, $\ddot{x}$ is the acceleration of wireline drum assembly 136, $m_{assy}\cdot g$ represents the force, $F_{assy}$, produced by the weight of wireline drum assembly 136, and $m_{assy}\cdot\ddot{x}$ represents the force produced by the inertia of wireline drum assembly 136.

The well load, $F_{well}$, varies over the course of a pump stroke due to various factors, including for example, and without limitation, well conditions and pump speed. The load variation contributes to the occurrence of force imbalance on roller screw 118 and the prime mover, which is motor 130 in rod pumping unit 100. Force imbalance on roller screw 118 manifests as torque imbalance. The relationship between motor torque, $T_{motor}$, and $F_{screw}$ is represented by the following equation:

$$T_{motor}(x)=F_{screw}(x)\cdot\frac{\gamma}{2\cdot\pi\cdot\eta}+I_{screw}\alpha, \quad \text{Eq. (2)}$$

where, $F_{screw}(x)$ is the load on roller screw 118 as a function of stroke position, x, $\gamma$ is the pitch of roller screw 118, $\eta$ is the efficiency of roller screw 118, $I_{screw}$ represents the inertia of roller screw 118, and $\alpha$ represents the angular acceleration of roller screw 118.

Motor torque imbalance is defined as a difference in absolute values of peak torque values during an upstroke and a downstroke as a percentage of the maximum of the two, i.e., a greater value of the two. Rod pumping unit 100 operates most efficiently when the motor torque imbalance value is zero. In certain embodiments, a desired range of motor torque imbalance is defined around zero and, further, an acceptable range of motor torque imbalance may be defined around the desired range of motor torque imbalance. Motor torque imbalance is desirably maintained within the desired imbalance range, however, if motor torque imbalance increases in magnitude beyond the desired imbalance range, but still within the acceptable imbalance range, corrections are not necessary. If motor torque imbalance increases in magnitude beyond the acceptable imbalance range, corrections are made to bring the motor torque imbalance back within the desired imbalance range. In one embodiment, for example, and without limitation, the desired range of motor torque imbalance values is defined inclusively as −5% to 5%, and the acceptable range of motor torque imbalance values is defined inclusively as −10% to 10%. If motor torque imbalance is measured to be 7%, no corrections are made. If the motor torque imbalance is measured to be 12%, corrections are made to bring the motor torque imbalance within the −5% to 5% range. Motor torque imbalance for a single pump stroke is generally determined after the pump stroke is complete and peak torque values are measured and known. Motor torque imbalance is defined by the following equation.

$$\text{Imbalance}=\frac{T_{peak,up}-T_{peak,down}}{\max(T_{peak,up},T_{peak,down})}\cdot 100, \quad \text{Eq. (3)}$$

where, $T_{peak,up}$ and $T_{peak,down}$ are peak motor torques for the upstroke and the downstroke.

Given a variable well load, $F_{well}$, the motor torque imbalance also varies over time and over one or more pump strokes. For example, the fluid in the system, such as air, may leak over time, contributing to an imbalanced system. Accordingly, the counter-balance effect of the counter-balance force, $F_{cbal}$, varies and is adjustable to control motor torque imbalance. The counter-balance in a linear pumping unit, such as rod pumping unit 100, is adjustable by engaging compressor 148 or bleed valve 150 to increase or decrease the quantity of the fluid in pressure vessel 104, affecting the pressure accordingly. Conventionally, when a motor torque imbalance outside an acceptable range is identified after a pump stroke is complete, an adjustment to the counter-balance is engaged and the motor torque imbalance is determined again after the next pump stroke. If the new motor torque imbalance is still outside a desired range, the adjustment remains engaged for another pump stroke. Otherwise, the adjustment is disengaged until another motor torque imbalance outside the acceptable range is identified after a subsequent pump stroke. Controlling adjustment of the counter-balance after motor torque imbalance is computed at the end of a stroke results in sub-optimal convergence on the desired imbalance range due to over-adjusting the counter-balance.

In rod pumping unit 100, two imbalance conditions are possible: an under-balance and an over-balance. In an under-balance condition, where the motor torque imbalance is positive, the counter-balance force, $F_{cbal}$, is low and should be increased to converge the motor torque imbalance on zero. In an over-balance condition, where the motor torque imbalance is negative, the counter-balance force, $F_{cbal}$, is high and should be decreased to converge the motor torque imbalance on zero.

In alternative embodiments, such as a beam pumping unit, for example, a counter-balance mass may be shifted. In another alternative embodiment, such as an air-balanced beam pumping unit, for example, a similar configuration of pressure vessel 104, compressor 148, and bleed valve 150 is used as a counter-balance. Referring again to rod pumping unit 100, the counter-balance force, $F_{cbal}(x)$, is defined by the following equation:

$$F_{cbal}(x)=P(x)\cdot A, \quad \text{Eq. (4)}$$

where,

A is the surface area of forcer ram 122, $F_{cbal}(x)$ is the counter-balance force as a function of stroke position, x, and P (x) is the pressure inside pressure vessel 104 as a function of stroke position, x, which is generally measurable or estimated in real-time.

Figure 4:
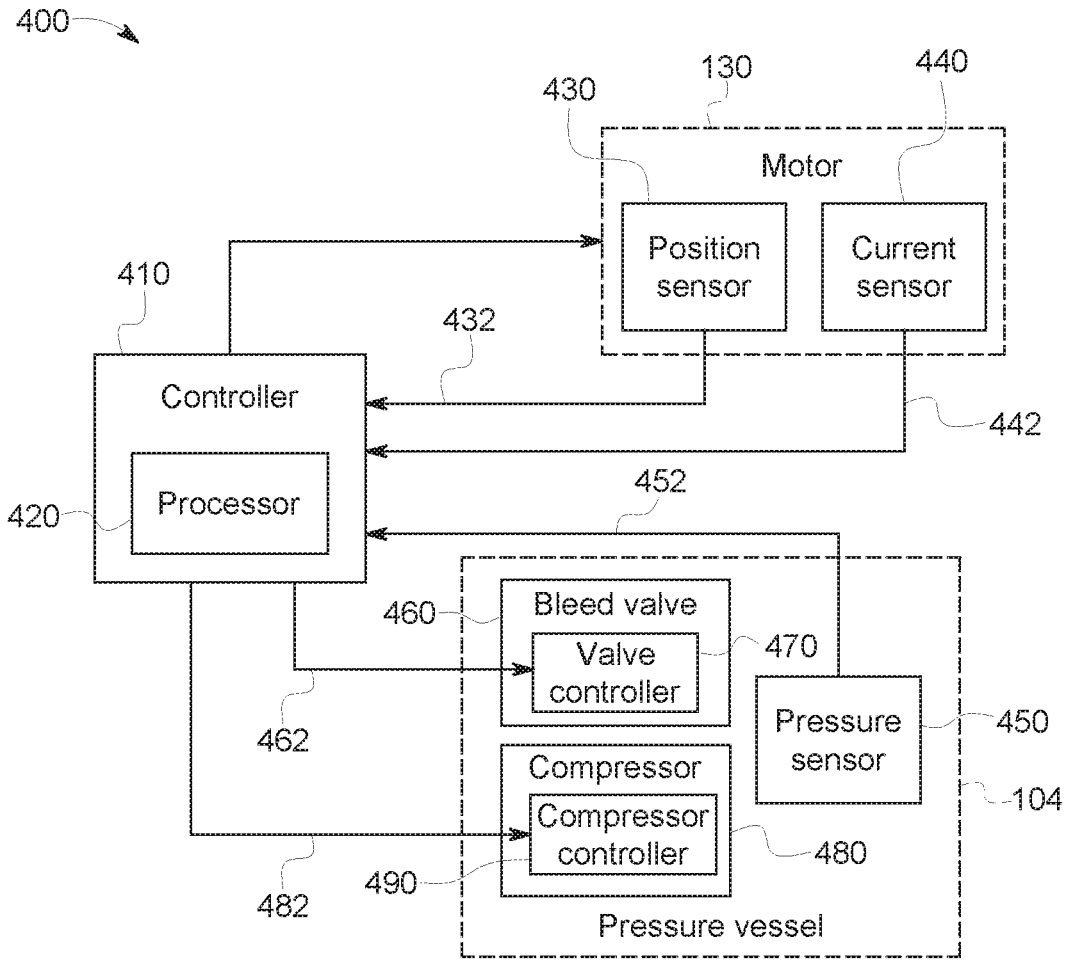
FIG. 4 is a block diagram of control system for the rod pumping unit shown in FIGS. 1 and 2.

FIG. 4 is a block diagram of a control system 400 for use with rod pumping unit 100 (shown in FIGS. 1 and 2). Control system 400 includes a controller 410 that operates motor 130 and includes a processor 420. Control system 400 further includes a position sensor 430 configured to measure stroke position, x, for rod pumping unit 100, and generate and transmit a position signal 432 to controller 410. In certain embodiments, position sensor 430 includes, for example, and without limitation, a linear transducer. In alternative embodiments, position sensor 430 includes, for example, and without limitation, an encoder on the prime mover, i.e., motor 130. In certain embodiments, position is estimated based on RPMs of motor 130. Control system 400 further includes a current sensor 440 configured to measure current supplied to motor 130. In alternative embodiments, torque is measured by a torque sensor or any other suitable measurement for estimating torque. The current supplied to motor 130 is directly related to motor torque, $T_{motor}$, which is further related to the load on roller screw 118, $F_{screw}$. Current sensor 440 is further configured to generate and transmit a load signal 442 to controller 410. Control system 400 further includes a pressure sensor 450 configured to measure pressure, P, inside pressure vessel 104. Pressure sensor 450 is further configured to generate and transmit a pressure signal 452 to controller 410.

Control system 400 further includes a bleed valve 460 coupled to pressure vessel 104. Bleed valve 460 is controlled by controller 410 using a valve control signal 462 transmitted to a valve controller 470 for bleed valve 460. When bleed valve 460 is engaged by controller 410, bleed valve 460 opens and decreases the fluid within pressure vessel 104. Control system 400 further includes a compressor 480 coupled to pressure vessel 104. Compressor 480 is controlled by controller 410 using a compressor control signal 482 transmitted to a compressor controller 490 for compressor 480. When compressor 480 is engaged by controller 410, compressor 480 increases the fluid within pressure vessel 104. When compressor 480 and bleed valve 460 are disengaged, the amount of fluid in pressure vessel 104 is maintained. In certain embodiments, the fluid within pressure vessel 104 changes over time even when compressor 480 and bleed valve 460 are disengaged. Typically, the fluid changes slowly. In such embodiments, controller 410 is configured to assume the amount of fluid remains constant from one stroke to the next when compressor 480 and bleed valve 460 are disengaged. If the fluid changes substantially within a stroke or other short period of time, such a change could induce errors in computations.

The pressure, P, within pressure vessel 104 changes as a function of stroke position, because the volume of pressure vessel 104 changes as forcer ram 122 translates on each upstroke and each downstroke. Controller 410 is configured to treat the compression of the fluid in pressure vessel 104 as a polytropic process, which is described by the following equation:

$$P(x)\cdot V(x)^n=C, \quad \text{Eq. (5)}$$

where,

P(x) is the pressure within pressure vessel 104 as a function of stroke position, x, V(x) is the volume of pressure vessel 104 as a function of stroke position, x, n is a polytropic index, and C is a constant for the compression of a fixed quantity of fluid.

Controller 410 is configured to model volume, V(x), based on known physical dimensions of pressure vessel 104 and stroke position, x. The polytropic index, n, is generally constant. Controller 410, in certain embodiments, is configured to estimate polytropic index, n, when neither of compressor 480 and bleed valve 460 are engaged, i.e., when the amount of fluid in pressure vessel 104 is constant. When compressor 480 or bleed valve 460 are engaged, controller 410 is configured to use a last-estimated value for polytropic index, n. Polytropic index, n, is estimated using a recursive least square estimator, or any other suitable estimator, including, for example, and without limitation, a Kalman filter, with a forgetting factor based on the equation below:

$$\log(P(x))=-n\cdot\log(V(x))+\log(C), \quad \text{Eq. (6)}$$

In alternative embodiments, controller 410 uses other relationships of pressure, P, and position, x. For example, and without limitation, a polynomial approximation (shown below) may be used.

$$P(x)=a_0+a_1x+a_2x^2\ldots \quad \text{Eq. (7)}$$

where, $a_0$, $a_1$, $a_2$, etc. are estimated using the recursive least square estimator or other suitable estimator, $a_0$ varies with the amount of fluid, and $a_1$ and $a_2$ are constant.

During operation of rod pumping unit 100, controller 410 is configured to receive position signal 432, load signal 442, and pressure signal 452. During a first stroke, controller 410 computes a first motor torque imbalance using load signal 442 and Eq. 3. The first motor torque imbalance is a function of a peak motor torque for the upstroke, $T_U^1$, and a peak motor torque for the downstroke, $T_D^1$, which are computed using Eq. 1 and Eq. 2. When the first motor torque imbalance is outside an acceptable imbalance range, adjustment of a counter-balance is engaged. In an under-balance condition, controller 410 engages compressor 480 by transmitting compressor control signal 482 to compressor controller 490. Compressor 480 increases the fluid in pressure vessel 104 and increases pressure, P. In an over-balance condition, controller 410 engages bleed valve 460 by transmitting valve control signal 462 to valve controller 470. Bleed valve 460 decreases the fluid in pressure vessel 104 and decreases pressure, P.

Controller 410 is configured to determine stroke positions at which peak motor torques, $T_U^1$ and $T_D^1$, occur during the first stroke. Peak motor torque $T_U^1$ occurs at peak motor torque stroke position $X_U^1$. Peak motor torque $T_D^1$ occurs at peak motor torque stroke position $X_D^1$. Controller 410 is further configured to determine peak pressures at positions $X_U^1$ and $X_D^1$, referred to as $P(X_U^1)$ and $P(X_D^1)$. Controller 410 is configured to use peak motor torque stroke positions for the first stroke as estimated peak motor torque stroke positions during the following stroke. Actual peak motor torque values and actual peak motor torque stroke positions are determinable for a given stroke once the stroke is complete.

During a second stroke, which may immediately follow the first stroke, or may be one or more strokes later, controller 410 is configured to estimate a second motor torque imbalance for the second stroke. To estimate the second motor torque imbalance, controller 410 is configured to measure a counter-balance component at a current stroke position based on pressure signal 452. In rod pumping unit 100, the measured counter-balance component is pressure, P. Controller 410 is configured to then use the counter-balance component at the current stroke position to estimate a counter-balance force at peak motor torque stroke positions in the second stroke. Based on the polytropic compression described in Eq. 5 and peak motor torque stroke positions $X_U^1$ and $X_D^1$, pressures in pressure vessel 104 are estimated at peak motor torque stroke positions $X_U^1$ and $X_D^1$ for the second stroke. The estimated pressures, $P(X_U^1)$ and $P(X_D^1)$, which are used as surrogate estimates for $P(X_U^2)$ and $P(X_D^2)$, are determined using the following equivalencies based on Eq. 5:

$$P(x)\cdot V(x)^n = P(X_U^1)\cdot V(X_U^1)^n \quad \text{Eq. (8)}$$

$$P(x)\cdot V(x)^n = P(X_D^1)\cdot V(X_D^1)^n \quad \text{Eq. (9)}$$

In certain embodiments, such as those using the polynomial relationship described in Eq. 7, pressures are estimated according to the following equation:

$$P(X_D^1) = (P(x) - a_1x - a_2x^2) + a_1X_D^1 + a_2X_D^{1^2} \quad \text{Eq. (10)}$$

The estimated pressures, $P(X_U^1)$ and $P(X_D^1)$, are then used to estimate peak motor torques, $T_U^2$ and $T_D^2$, for the second stroke using Eq. 1, Eq. 2, and Eq. 4, as shown below, collectively referred to as Eq. 11, where $F_{cbal}$ varies between strokes and other terms are assumed to remain constant. For $T_U^2$:

$$F_{cbal}^1(X_U^1) = P_U^1 A \quad \text{Eq. (11)}$$

$$F_{cbal}^2(X_U^1) = P(X_U^1)A$$

$$F_{screw}^1(X_U^1) = 2\cdot F_{well}(X_U^1) + m_{assy}\cdot g + m_{assy}\cdot \ddot{x} - F_{cbal}^1(X_U^1)$$

$$F_{screw}^2(X_U^1) = 2\cdot F_{well}(X_U^1) + m_{assy}\cdot g + m_{assy}\cdot \ddot{x} - F_{cbal}^2(X_U^1)$$

$$F_{screw}^2(X_U^1) = F_{screw}^1(X_U^1) + F_{cbal}^1(X_U^1) - F_{cbal}^2(X_U^1)$$

-continued $$T_U^1 = F_{screw}^1(X_U^1)\cdot \frac{\gamma}{2\cdot\pi\cdot\eta} + I_{screw}\alpha$$

$$T_U^2 = F_{screw}^2(X_U^1)\cdot \frac{\gamma}{2\cdot\pi\cdot\eta} + I_{screw}\alpha$$

$$T_U^2 = (F_{s1crew}^1(X_U^1) + F_{cbal}^1(X_U^1) - F_{cbal}^2(X_U^1))\cdot \frac{\gamma}{2\cdot\pi\cdot\eta} + I_{screw}\alpha$$

$$T_U^2 = F_{screw}^1(X_U^1)\cdot \frac{\gamma}{2\cdot\pi\cdot\eta} + I_{screw}\alpha + (F_{cbal}^1(X_U^1) - F_{cbal}^2(X_U^1))\cdot \frac{\gamma}{2\cdot\pi\cdot\eta}$$

$$T_U^2 = T_U^1 + (P_U^1 - P(X_U^1))\cdot A\cdot \frac{\gamma}{2\cdot\pi\cdot\eta}$$

Likewise, the computations, collectively referred to as Eq. 11, are repeated for $T_D^2$.

The estimated peak motor torques, $T_U^2$ and $T_D^2$, are then used to estimate a second motor torque imbalance for the second stroke using Eq. 3, in real-time during the second stroke.

When the estimated second motor torque imbalance, during the second stroke, is in a desired imbalance range, adjustment of the counter-balance is disengaged by disengaging both bleed valve 460 and compressor 480. If motor torque imbalance goes outside the acceptable imbalance range again, adjustment of the counter-balance is engaged until motor torque imbalance is back inside the desired imbalance range.

Figure 5:
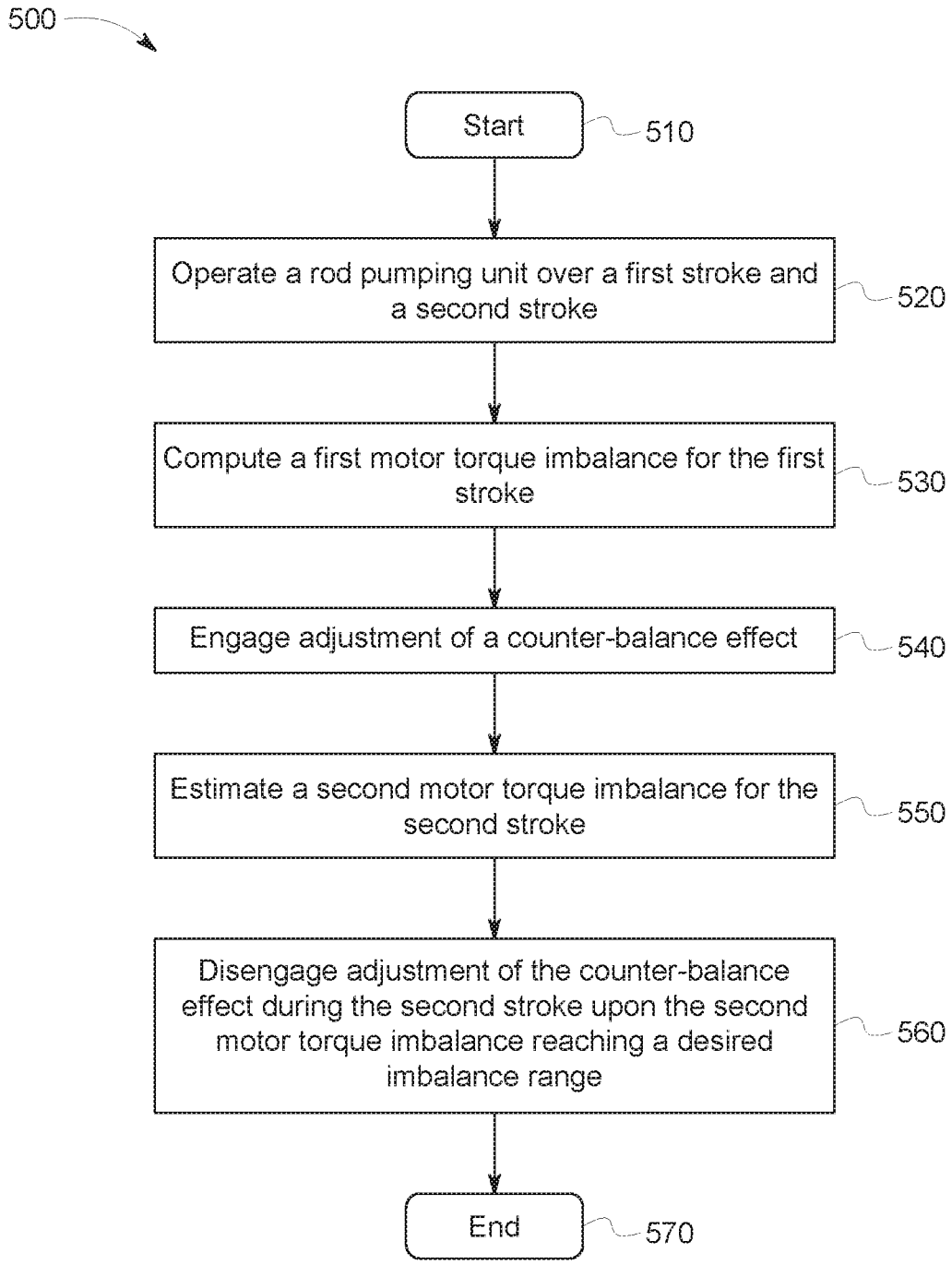
FIG. 5 is a flow diagram of an exemplary method of operating the controller shown in FIG. 4.

FIG. 5 is a flow diagram of an exemplary method 500 of operating controller 410 (shown in FIG. 4). Referring to FIGS. 4 and 5, the method begins at a start step 510. At an operating step 520, controller 410 operates the prime mover of rod pumping unit 100, i.e., motor 130, over multiple pump strokes, including a first stroke and a second stroke. When the first stroke is complete, controller 410 is configured to compute a first motor torque imbalance for the first stroke at a computing imbalance step 530. The first motor torque imbalance is computed based on a load signal 442 from a sensor, such as current sensor 440. Controller 410 uses load signal 442 to identify peak torque values, $T_U^1$ and $T_D^1$, for the upstroke and downstroke of the first stroke, and then uses the peak torque values to compute the first motor torque imbalance based on Eq. 3.

When the first motor torque imbalance indicates an imbalance outside an acceptable imbalance range, controller 410 engages adjustment of a counter-balance at an engaging adjustment step 540. Engaging adjustment includes engaging compressor 480 or bleed valve 460 to increase or decrease the fluid in pressure vessel 104, thus increasing or decreasing the pressure that contributes to the counter-balance force. Compressor 480 is engaged by transmitting compressor control signal 482 to compressor controller 490. Bleed valve 460 is engaged by transmitting valve control signal 462 to valve controller 470.

During the second stroke, stroke position and pressure are measured using position sensor 430 and pressure sensor 450. At an estimating imbalance step 550, controller 410 estimates a second motor torque imbalance for the second stroke. Controller 410 uses a current pressure and a current stroke position, during the second stroke, to estimate pressures, $P(X_U^1)$ and $P(X_D^1)$, based on Eq. 5. The estimated pressures, $P(X_U^1)$ and $P(X_D^1)$, are then used to estimate peak motor torques, $T_U^2$ and $T_D^2$, for the second stroke using Eq. 1, Eq. 2, and Eq. 4. The estimated peak motor torques, $T_U^2$ and $T_D^2$, are then used to estimate the second motor torque imbalance for the second stroke using Eq. 3, in real-time during the second stroke.

When the second motor torque imbalance, during the second stroke, is in a desired imbalance range, adjustment of the counter-balance is disengaged at a disengaging adjustment step 560 by disengaging both bleed valve 460 and compressor 480. If motor torque imbalance goes outside the acceptable imbalance range again, adjustment of the counter-balance is engaged until motor torque imbalance is back inside the desired imbalance range. Method 500 ends at an end step 570.

The above described controllers for rod pumping units, within a rod pumping unit stroke, estimate torque imbalance on the prime mover for that stroke based on measured torque imbalance for a previous stroke. The controllers use the estimated torque imbalance to engage or disengage an adjustment to a counter-balance in real-time within the stroke. Real-time engagement and disengagement of adjustments to the counter-balance facilitate the controllers operating the rod pumping unit such that torque imbalance on the prime mover efficiently converges to a desired range.

An exemplary technical effect of the methods, systems, and apparatus described herein includes at least one of: (a) estimating torque imbalance on the prime mover for a stroke within that stroke, (b) engaging and disengaging of counter-balance adjustments in real-time based on estimated torque imbalance, (c) reducing under-shoot and over-shoot of counter-balance force, (d) improving torque imbalance convergence, and (e) improving operating efficiency of rod pumping units due to improved torque imbalance convergence.

Exemplary embodiments of methods, systems, and apparatus for rod pumping unit controllers are not limited to the specific embodiments described herein, but rather, components of systems and/or steps of the methods may be utilized independently and separately from other components and/or steps described herein. For example, the methods may also be used in combination with other non-conventional rod pumping unit controllers, and are not limited to practice with only the systems and methods as described herein. Rather, the exemplary embodiment can be implemented and utilized in connection with many other applications, equipment, and systems that may benefit from reduced cost, reduced complexity, commercial availability, improved reliability at high temperatures, and increased memory capacity.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A controller for operating a prime mover of a rod pumping unit, said controller comprising a processor configured to:

operate the prime mover over a first stroke and a second stroke;

compute a first motor torque imbalance value for the first stroke;

engage adjustment of a counter-balance; and estimate a second motor torque imbalance value for the second stroke, wherein the controller estimates the second motor torque imbalance value using a counter-balance component at a current stroke position based on a pressure signal; and disengage adjustment of the counter-balance during the second stroke upon the second motor torque imbalance value reaching a first imbalance range, wherein said processor is further configured, for estimating the second motor torque imbalance value, to:

determine a peak upstroke motor torque and a peak downstroke motor torque of the prime mover for the first stroke;

determine peak-torque stroke positions at which the peak upstroke motor torque and the peak downstroke motor torque occur in the first stroke;

measure the counter-balance component at the current stroke position, x, during the second stroke;

compute estimated counter-balance forces at the peak-torque stroke positions for the second stroke based on the counter-balance component and the current stroke position, x;

compute an estimated peak upstroke motor torque and an estimated peak downstroke motor torque based on the estimated counter-balance forces, the peak upstroke motor torque, and the peak downstroke motor torque; and compute the second motor torque imbalance value based on the estimated peak upstroke motor torque and the estimated peak downstroke motor torque, wherein the counter-balance comprises a counter-balance force generated by pressure in a pressure vessel acting on a ram coupled to the prime mover, and wherein said processor is further configured, for computing the estimated counter-balance forces, to:

during a period when the counterbalance adjustment is engaged:

compute a polytropic compression, C, based on a current pressure and a current volume of the pressure vessel at the current stroke position, x, with a polytropic index, n, being held constant at a last estimated value;

compute volumes of the pressure vessel at the peak-torque stroke positions for the second stroke;

compute estimated pressures in the pressure vessel at the peak-torque stroke positions for the second stroke;

compute the estimated counter-balance forces based on the estimated pressures;

during the period when counterbalance adjustment is disengaged:

estimate the polytropic index, n, and polytropic compression, C, in real-time based on a current pressure signal and current stroke position.

2. A controller in accordance with claim 1, wherein the first imbalance range is defined inclusively as −5% to 5%.

3. A controller in accordance with claim 1, wherein said processor is further configured to engage one of a compressor and a bleed valve for the pressure vessel to engage adjustment of the counter-balance.

4. A controller in accordance with claim 3, wherein said processor is further configured to disengage the compressor and the bleed valve to disengage adjustment of the counter-balance.

5. A method of operating a rod pumping unit, said method comprising:

operating a prime mover of the rod pumping unit over a first stroke and a second stroke;

computing a first motor torque imbalance value for the first stroke;

engaging adjustment of a counter-balance;

estimating a second motor torque imbalance value for the second stroke, wherein the estimating comprises a counter-balance component at a current stroke position on a pressure signal;

disengaging adjustment of the counter-balance during the second stroke upon the second motor torque imbalance value reaching a first imbalance range, computing a polytropic compression, C, based on a current pressure and a current volume of a pressure vessel at the current stroke position, x to:

estimate a polytropic index, n, in real-time based on a current pressure signal when adjustment to the counter-balance is disengaged; and utilize a last-estimated polytropic index, n, when adjustment to the counter-balance is engaged.

6. The method in accordance with claim 5, wherein the counter-balance comprises a counter-balance force generated by pressure in the pressure vessel acting on a ram coupled to the prime mover.

7. The method in accordance with claim 6, wherein the first motor torque imbalance value indicates an under-balance condition, wherein the engaging adjustment of the counter-balance comprises engaging a compressor to increase the pressure in the pressure vessel, and wherein disengaging adjustment of the counter-balance comprises disengaging the compressor to maintain the pressure in the pressure vessel.

8. The method in accordance with claim 7 further comprising:

computing a third motor torque imbalance value for a third stroke, the third motor torque imbalance value falling outside a second imbalance range and indicating an over-balance condition;

engaging a bleed valve to decrease the pressure in the pressure vessel to adjust the counter-balance;

estimating a fourth motor torque imbalance value for a fourth stroke; and disengaging the bleed valve to maintain the pressure in the pressure vessel upon the fourth motor torque imbalance value reaching the first imbalance range.

9. The method in accordance with claim 5, wherein estimating the second motor torque imbalance value comprises:

determining a peak upstroke motor torque and a peak downstroke motor torque of the prime mover for the first stroke;

determining peak-torque stroke positions at which the peak upstroke motor torque and the peak downstroke motor torque occur in the first stroke;

measuring the counter-balance component at the current stroke position, x, during the second stroke;

computing estimated counter-balance forces at the peak-torque stroke positions for the second stroke based on the counter-balance component and the current stroke position, x;

computing an estimated peak upstroke motor torque and an estimated peak downstroke motor torque based on the estimated counter-balance forces, the peak upstroke motor torque, and the peak downstroke motor torque; and computing the second motor torque imbalance value based on the estimated peak upstroke motor torque and the estimated peak downstroke motor torque.

10. The method in accordance with claim 9, wherein the counter-balance comprises a counter-balance force generated by pressure in the pressure vessel acting on a ram coupled to the prime mover, and wherein computing the estimated counter-balance forces comprises:

estimating a plurality of coefficients for a polynomial approximation of pressure as a function of stroke position based on a current pressure and the current stroke position, x;

computing estimated pressures in the pressure vessel at the peak-torque stroke positions based on the polynomial approximation, the current stroke position, x, and the plurality of coefficients; and computing the estimated counter-balance forces based on the estimated pressures.

11. A rod pumping unit, comprising:

a pressure vessel within which a ram translates;

a prime mover coupled to the ram within said pressure vessel;

a compressor coupled to said pressure vessel, said compressor configured to increase a pressure in said pressure vessel when engaged;

a bleed valve coupled to said pressure vessel, said bleed valve configured to decrease the pressure in said pressure vessel when engaged;

a rod pumping unit controller coupled to said compressor and said bleed valve, said controller configured to:

operate said prime mover over a first stroke and a second stroke;

compute a first motor torque imbalance value for the first stroke;

engage one of said compressor and said bleed valve to adjust a counter-balance;

estimate a second motor torque imbalance value for the second stroke, wherein the controller estimates the second motor torque imbalance value using a counter-balance component at a current stroke position based on a pressure signal;

disengage said compressor and said bleed valve during the second stroke upon the second motor torque imbalance value reaching a first imbalance range, wherein the rod pumping unit further comprises:

a position sensor configured to measure a stroke position of said prime mover and generate a position signal indicative thereof;

a load sensor configured to measure a load on said prime mover and generate a load signal indicative thereof; and the pressure sensor configured to measure the pressure in said pressure vessel acting on the ram to generate a counter-balance force, and to generate a pressure signal indicative thereof, wherein:

said rod pumping unit controller is further coupled to said position sensor, said load sensor, and said pressure sensor, and is further configured to:

compute the first motor torque imbalance value based on the load signal for the first stroke; and estimate the second motor torque imbalance value based on the load signal for the first stroke, the position signal for the first stroke, a current position signal, and a current pressure signal, wherein the rod pumping unit controller is further configured, for estimating the second motor torque imbalance value, to:

determine a peak upstroke motor torque and a peak downstroke motor torque of said prime mover for the first stroke based on the load signal for the first stroke;

determine peak-torque stroke positions at which the peak upstroke motor torque and the peak downstroke motor torque occur in the first stroke based on the position signal for the first stroke;

measure the counter-balance component at the current stroke position, x, during the second stroke based on the current pressure signal and the current position signal;

compute estimated counter-balance forces at the peak-torque stroke positions for the second stroke based on the counter-balance component and the current stroke position, x;

compute an estimated peak upstroke motor torque and an estimated peak downstroke motor torque based on the estimated counter-balance forces, the peak upstroke motor torque, and the peak downstroke motor torque;

compute the second motor torque imbalance value based on the estimated peak upstroke motor torque and the estimated peak downstroke motor torque;

compute a polytropic compression, C, based on the current pressure signal and a current volume of said pressure vessel at the current stroke position, x;

compute volumes of said pressure vessel at the peak-torque stroke positions for the second stroke;

compute estimated pressures in said pressure vessel at the peak-torque stroke positions for the second stroke; and compute the estimated counter-balance forces based on the estimated pressures, wherein the polytropic compression, C, is computed to estimate a polytropic index, n, in real-time based on the current pressure signal when adjustment to the counter-balance is disengaged; and utilize a last-estimated polytropic index, n, when adjustment to the counter-balance is engaged.

12. The rod pumping unit in accordance with claim 11, wherein said rod pumping unit controller is further configured to engage said one of said compressor and said bleed valve when the first motor torque imbalance value falls outside of a second imbalance range.

* * * * *